United States Patent [19]

Bucher et al.

[11] 4,181,524

[45] Jan. 1, 1980

[54] FREE MACHINING HIGH SULFUR STRAND CAST STEEL

[75] Inventors: John H. Bucher; Eugene J. Paliwoda, both of Bethel Park, Pa.

[73] Assignee: Jones & Laughlin Steel Corporation, Pittsburgh, Pa.

[21] Appl. No.: 914,326

[22] Filed: Jun. 12, 1978

[51] Int. Cl.[2] ..... C22C 38/04; C22C 38/60

[52] U.S. Cl. ..... 75/123 G; 75/123 N

[58] Field of Search ..... 78/123 G, 123 N; 148/12 B, 36

[56] References Cited

U.S. PATENT DOCUMENTS

| | | | |
|---|---|---|---|
| 2,013,137 | 9/1935 | Crafts | 75/123 G |
| 2,319,635 | 5/1943 | Saylor | 75/123 G |
| 3,908,431 | 9/1975 | Jones et al. | 148/12 B |
| 3,973,950 | 8/1976 | Itoh et al. | 75/123 E |

FOREIGN PATENT DOCUMENTS

| | | | |
|---|---|---|---|
| 737365 | 7/1943 | Fed. Rep. of Germany | 75/123 G |
| 709828 | 5/1931 | France | 75/123 G |

*Primary Examiner*—Arthur J. Steiner
*Attorney, Agent, or Firm*—Thomas H. Murray

[57] ABSTRACT

An iron base alloy having excellent machinability characterized in having a high sulfur content in the form of small, uniformly distributed particles of manganese sulfide in its microstructure. The alloy, produced by strand-casting techniques to form billets which are subsequently hot-worked into bars or other shapes, consists essentially of up to about 0.50% carbon, 1.15 to 1.35% manganese, at least 0.40% sulfur, about 0.15 to 0.30% silicon and the remainder substantially all iron with incidental impurities.

3 Claims, 3 Drawing Figures

FREE MACHINING HIGH SULFUR STRAND CAST STEEL

BACKGROUND OF THE INVENTION

As is known, the so-called free-machining carbon steel bars which do not contain lead are classified as either the 1200 Series grades or the 1100 Series grades. Steels of this type typically contain no more than about 0.35% sulfur and at least 0.30% manganese which forms, with the sulfur, manganese sulfide particles which act to improve machinability.

In the past, most alloys of this type have been formed by initial casting into ingots, the resulting ingots being processed in a blooming mill into billets which are subsequently rolled into desired shapes such as bars. When sulfur-containing steels are formed in this manner, the sulfur content cannot be increased above about 0.35% for the reasong that sulfur above this limit forms iron sulfide, regardless of the amount of manganese added, which severely reduces the hot-workability of the steel to the point where it cannot be successfully hot-rolled. Nevertheless, higher amounts of manganese sulfide in the microstructure would further improve machinability of the alloy.

SUMMARY OF THE INVENTION

In accordance with the present invention, it has been found that when a sulfur-containing steel alloy is strand-cast into billets, higher amounts of sulfur, up to about 0.65% can be added to improve machinability without incurring the deleterious effects of iron sulfide. It has been found that by forming the alloy into billets in a strand-casting process, a dense, uniform distribution of small particles of manganese sulfide results, providing a material with excellent machinability. The essential alloying additions are carbon manganese and sulfur, with carbon being present up to about 0.50% by weight, manganese up to about 1.35% by weight and sulfur present in the range of about 0.40 to 0.65% by weight.

The above and other objects and features of the invention will become apparent from the following detailed description taken in connection with the accompanying drawings which form a part of this specification, and in which.

The alloy of the invention has the following broad and preferred ranges of composition:

TABLE I

| | Broad | Preferred |
|---|---|---|
| C | .09-.48% | .09-.15%*<br>.14-.22%**<br>.40-.48%*** |
| Mn | 1.05-1.35% | 1.15-1.35% |
| S | .40% min | .45-.65% |
| Si | .01-.30% | .10% max |

TABLE I-continued

| | Broad | Preferred |
|---|---|---|
| Fe | Bal. | Bal. |

*for optimum machinability
**for carburizing applications
***for optimum strength As can be seen from Table I, the broad range for carbon is 0.09 to 0.48%; however the preferred range is dependent upon the use to which the alloy is to be put. For optimum machinability, the carbon content should be between about 0.09 and 0.15%; for carburizing applications, it should be between about 0.14 to 0.22%; and for optimum strength, the carbon should be increased to between about 0.40 to 0.48%. The range of manganese must be closely controlled. It should not exceed 1.35% but can be as low as 1.05%. As was explained above, the minimum sulfur content is 0.40%, but preferably is in the range of about 0.45 to 0.65%. Silicon, which is used as a deoxidizer, can be present in the range of 0.01 to 0.30%; however, it should not exceed 0.10% when special deoxidants such as calcium and aluminum are employed as described below.

The invention resides not only in the alloy composition given above but also in the fact that the alloy is continuously cast into billets. That is, the molten alloy is poured into the tundish of a continuous casting machine and thence flows into the oscillating mold of a continuous caster to form a continuous strand which is then cut into billets of suitable length. When a maximum of 0.10% silicon is employed in the alloy, a special deoxidant such as calcium in the tundish and aluminum in the mold can be employed. That is, aluminum wire is fed into the mold during the continuous casting process to achieve a coarse grain level (typically 0.002/0.008%) to minimize pinholes and oxide inclusions.

Figure 1:
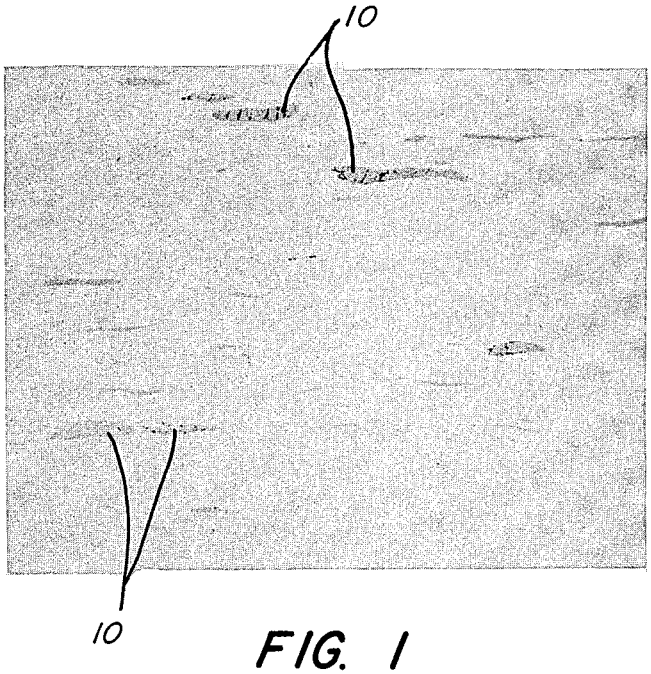
FIG. 1 (PRIOR ART)
FIG. 1 is a photomicrograph of a prior art sulfur-containing steel produced from an ingot, showing the characteristics of the particles of manganese sulfide therein.

FIG. 1 comprises a photomicrograph of a typical prior art alloy containing less than 0.40% sulfur as is produced by casting into ingots followed by an appropriate hot-rolling process. The manganese sulfide particles in the microstructure are identified by the reference numeral 10; and it will be noted that they are relatively large and random in orientation. As was explained above, in a steel of this type which is initially cast into ingots, the sulfur content cannot be increased above about 0.35% for the reason that sulfur above this limit forms iron sulfide which severely reduces the hot-workability to the point where the alloy cannot be successfully hot-rolled.

Figure 2:
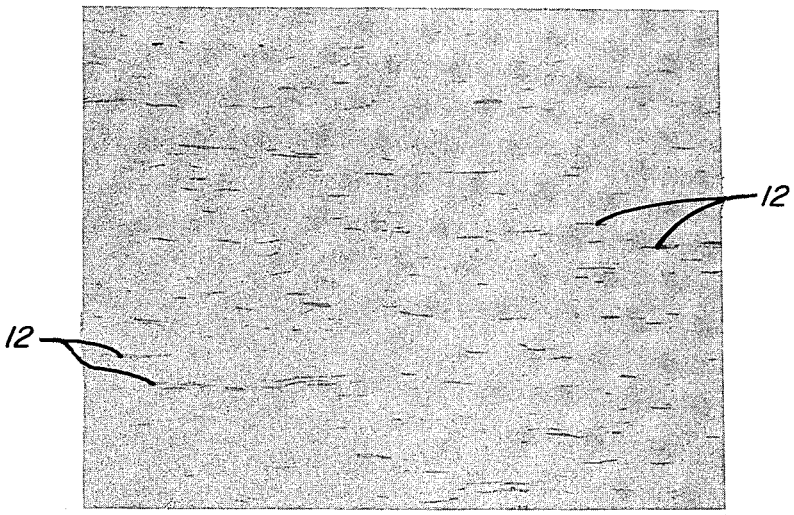
FIG. 2 is a photomicrograph of the improved alloy of the invention showing the fine and uniform dispersion of small particles of manganese sulfide therein.

In FIG. 2, the microstructure of the improved alloy of the present invention is shown wherein the manganese sulfide particles are identified by the reference numeral 12. It will be noted that they are much smaller than those of the prior art alloy shown in FIG. 1 and are much more uniformly distributed throughout the microstructure. This gives the improved machinability characteristics of the alloy about to be described.

Figure 3:
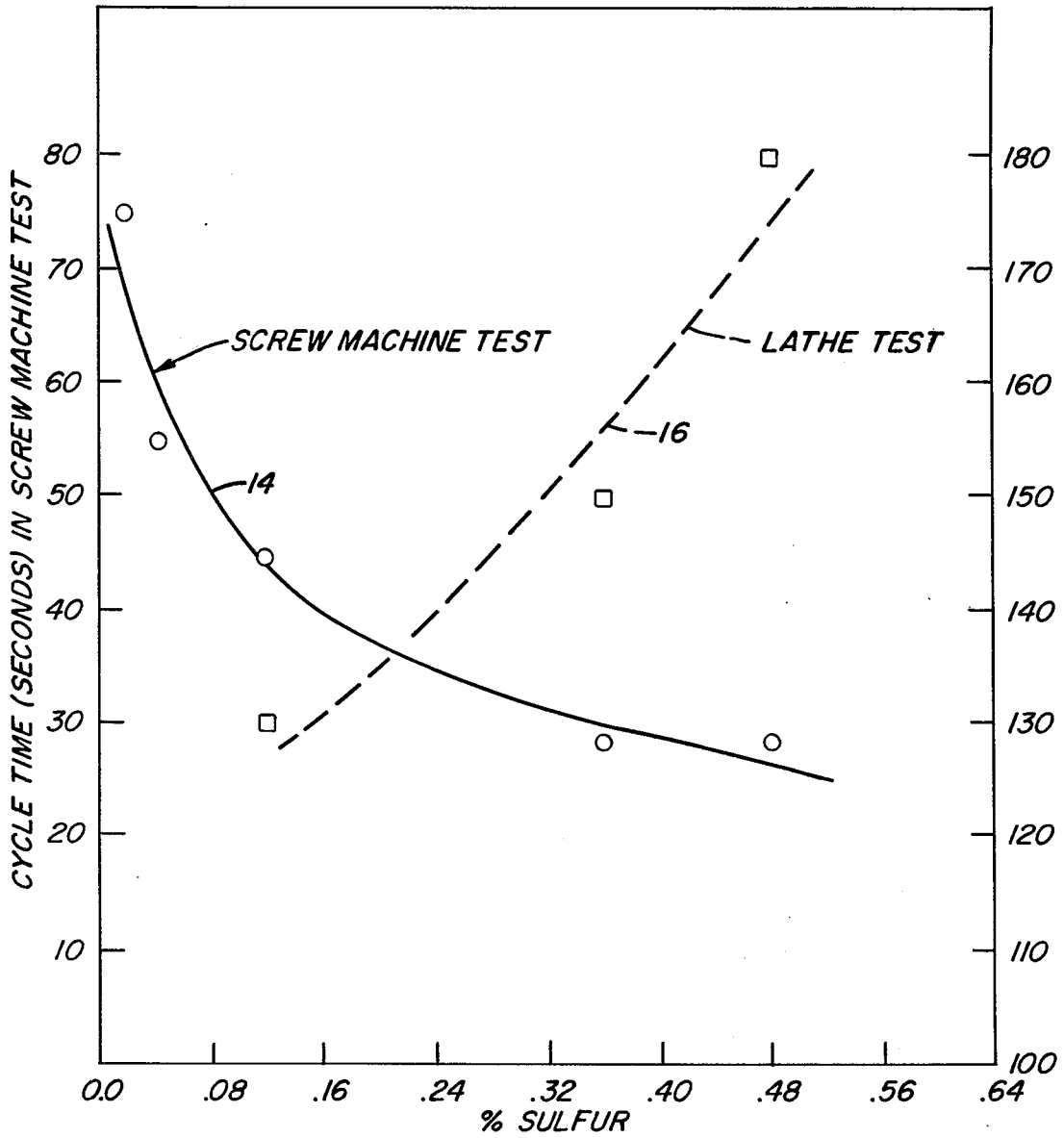
FIG. 3 is a plot of cycle time in a screw machine test for the alloy of the invention versus percent sulfur, showing the effect of the sulfur content of the alloy on machinability for carburizing grades.

In FIG. 3, the effect of sulfur on machinability for carburizing grades of steel containing approximately 0.18% carbon is shown. Two curves are plotted on the graph, curve 14 being a plot derived from a screw machine test and curve 16 being derived from a lathe test. The screw maching cycle time is the shortest time (per part) in which satisfactory parts can be produced continuously for an eight-hour period. Satisfactory parts will have a maximum surface roughness of about 125 microinches, and the size of the last part produced will be no more than 0.003 inch larger than the first part. When the cycle time is decreased for a particular heat of steel, the cutting speed is correspondingly increased. The size and roughness of the test parts are directly related to tool wear. All measurements are made on the major diameter of the test part which is rough formed from 1.0 inch diameter to 0.941 inch, and then finished formed to 0.937 inch.

The lathe test is performed by removing two cubic inches of metal with a hardened (i.e., 55 $R_c$) single-point turning tool. The cutting speed is alternately increased in 10 SFM increments until the fastest speed is established without encountering abrupt deterioration of the cutting tool tip. The depth of the cut is 1/16 inch, while the tool advances at a feed rate of 0.0031 inch per revolution. The lathe test is performed without lubrication, in contrast with the automatic screw machine.

Ordinarily, the lathe test rating for cold-finished bars is defined as the fastest cutting speed for which the cutting tool tip wear does not exceed 0.00125 inch. However, it is not possible to utilize this criterion for testing hot-rolled bars. As a consequence, the above procedure was used for both cold-finished and hot-rolled bars. The lathe test results indicate a significant dependence on bar size which may reflect either vibration or temperature effects since small diameter bars are turned at a higher RPM to obtain a given surface cutting speed. Because of dependence, the lathe test results were not averaged. As can be seen from FIG. 3, sulfur above 0.40% dramatically increases the lathe test and screw machine test characteristics of the alloy.

Although the invention has been shown in connection with certain specific embodiments, it will be readily apparent to those skilled in the art that various changes in composition and method of production may be made to suit requirements without departing from the spirit and scope of the invention

We claim as our invention:

1. A free machining high sulfur strand-cast steel billet characterized in having a microstructure containing a uniform distribution of small manganese sulfide particles and consisting of about 0.90 to 0.48% carbon, 1.05 to 1.35% manganese, 0.40 to 0.65% sulfur, 0.01 to 0.30% silicon, and the balance substantially all iron with incidental impurities.

2. The alloy of claim 1 wherein manganese is present in the range of about 1.15 to 1.35%, sulfur is present in the range of about 0.45 to 0.65% and silicon is present in an amount no greater than 0.10%.

3. A free machining high sulfur strand-cast steel billet consisting essentially of about 0.09 to 0.48% carbon, 1.05 to 1.35% manganese, 0.40 to 0.65% sulfur, 0.01 to 0.30% silicon, and the balance substantially all iron with incidental impurities, the billet being characterized in having a microstructure containing a uniform distribution of small manganese sulfide particles, the particles being smaller in size than those appearing in the microstructure of an alloy containing less than 0.40% sulfur as is produced by casting the alloy into ingots which are subsequently rolled into billets.

* * * * *